US007958897B2

(12) United States Patent
Uchinashi

(10) Patent No.: US 7,958,897 B2
(45) Date of Patent: Jun. 14, 2011

(54) ULTRASONIC HAIR TREATMENT DEVICE

(75) Inventor: Sakae Uchinashi, Moriguchishi (JP)

(73) Assignee: Panasonic Electric Works Co., Ltd, Osaka (JP)

( * ) Notice: Subject to any disclaimer, the term of this patent is extended or adjusted under 35 U.S.C. 154(b) by 557 days.

(21) Appl. No.: 12/088,140

(22) PCT Filed: Sep. 12, 2006

(86) PCT No.: PCT/JP2006/318458

§ 371 (c)(1),
(2), (4) Date: Mar. 26, 2008

(87) PCT Pub. No.: WO2007/037143

PCT Pub. Date: Apr. 5, 2007

(65) Prior Publication Data

US 2010/0180909 A1 Jul. 22, 2010

(30) Foreign Application Priority Data

Sep. 27, 2005 (JP) ..... 2005-280921

(51) Int. Cl.
*A45D 2/00* (2006.01)
*A45D 2/40* (2006.01)

(52) U.S. Cl. ..... 132/223; 132/225

(58) Field of Classification Search ..... 132/223–232; 219/222

See application file for complete search history.

(56) References Cited

U.S. PATENT DOCUMENTS

2004/0003824 A1* 1/2004 Habibi ..... 132/224

FOREIGN PATENT DOCUMENTS

| | | |
|---|---|---|
| GB | 985932 | 3/1965 |
| JP | 9-262120 | 10/1997 |
| JP | 2000-079013 | 3/2000 |
| JP | 2001-037526 | 2/2001 |
| JP | 2001-070881 | 3/2001 |
| JP | 2005-334256 | 12/2005 |

OTHER PUBLICATIONS

English language Abstract of JP 2001-070881.
English language Abstract of JP 2001-037526.
English language Abstract of JP 9-262120.

* cited by examiner

*Primary Examiner* — Rachel R Steitz
(74) *Attorney, Agent, or Firm* — Greenblum & Bernstein P.L.C.

(57) ABSTRACT

In an ultrasonic hair treatment device comprising a vibrator having a vibration element for generating ultrasonic vibrations and a receiver facing the vibrator as to apply the ultrasonic vibrations to a bundle of hairs which is pinched between the vibrator and the receiver, the vibration element has an oblong plate shape so as to have a plurality of resonance points arranged like a periodic lattice on a vibration face disposed in a thickness direction thereof, a plurality of circular recesses or grooves for trapping a hair treatment agent therein is formed on a vibration face of a head of the vibrator facing the receiver corresponding to the resonance points of the vibration element.

5 Claims, 5 Drawing Sheets

ULTRASONIC HAIR TREATMENT DEVICE

TECHNICAL FIELD

The present invention relates to an ultrasonic hair treatment device for transmitting ultrasonic vibrations generated by a vibration element of a vibrator to hairs while pinching the hairs between the vibrator and a receiver, and especially relates to an ultrasonic hair treatment device used for accelerating impregnation of hair treatment agent into hairs by ultrasonic vibrations while pinching the hair into which the hair treatment agent is impregnated between the vibrator and the receiver.

BACKGROUND ART

For example, Japanese Laid-Open Patent Publication No. 9-262120 discloses a conventional ultrasonic hair treatment device having a vibration element for converting electric signals to mechanical vibrations in an ultrasonic range, in which ultrasonic vibrations generated by the vibration element are applied to hairs and hair treatment agent so as to accelerate impregnation of the hair treatment agent into the hairs.

The ultrasonic hair treatment device comprises a pair of pinching members which are rotatable coupled with each other at an end of each pinching members, a vibrator having a disc shaped vibration element and provided at a free end of one pinching member and a receiver provided at a free end of the other pinching member so as to face the vibrator. For example, a bundle of hairs to which the hair treatment agent is spread is pinched between flat faces of the vibrator and the receiver. Under such a condition, the ultrasonic hair treatment device is moved along lengthwise direction of the bundle of hairs (or a direction for extending the hairs), while applying the ultrasonic vibrations generated in thickness direction by the vibration element to the hairs and the hair treatment agent. Thereby, impregnation of the hair treatment agent into the hairs entirely along the lengthwise direction can be accelerated.

Since the vibration element of the conventional ultrasonic hair treatment device is a disc shape, amplitude of the vibrations in the thickness direction becomes the largest at the center portion of the disc shape, and the amplitude of the vibration becomes smaller as departing from the center toward periphery in radial direction of the disc shape. In other words, resonance point, that is, the point where the amplitude of vibrations in the thickness direction becomes the largest of the disc shaped vibration element is only positioned at the center of the disc shape, so that the vibration element rarely vibrates the hairs and the hair treatment agent at the peripheral portion thereof, although it can vibrate the hairs and the hair treatment agent sufficiently at the center portion. Consequently, it is difficult to impregnate the hair treatment agent into the hairs entirely even in widthwise direction of the bundle of hairs.

Furthermore, since the hair treatment agent cannot be impregnated into the hairs sufficiently at the periphery portion of the disc shape of the vibration element, especially, at both end portion of the bundle of hairs in the widthwise direction thereof perpendicular to the longitudinal direction of the bundle of hairs, a treatment time necessary for treating the hairs becomes longer. Still furthermore, since the hairs are pinched between the flat faces of the vibrator and the receiver, the hair treatment agent cannot contact with the hairs completely, and thus, the hair treatment agent cannot be impregnated into the hairs sufficiently. Still furthermore, the hairs at a position corresponding to the resonance point of the vibration element may not be spread the hair treatment agent sufficiently while the hairs are pinched between the vibrator and the receiver, so that the hair treatment agent cannot be impregnated into the hairs effectively.

DISCLOSURE OF INVENTION

A purpose of the present invention is to solve the above mentioned problem and to provide an ultrasonic hair treatment device by which the hair treatment agent can be impregnated into the entire of the bundle of hairs evenly and surely, so that the treatment time can be shortened, power consumption of the processor can be reduced, and the hair treatment agent can be impregnated into the hair effectively and sufficiently.

For accomplishing the above-mentioned purpose, an ultrasonic hair treatment device in accordance with an aspect of the present invention comprises a vibrator having a vibration element for generating ultrasonic vibrations and a receiver facing the vibrator as to apply the ultrasonic vibrations to a bundle of hairs which is pinched between the vibrator and the receiver. The vibration element has an oblong plate shape so as to have a plurality of resonance points arranged like a periodic lattice on a vibration face disposed in a thickness direction thereof. A plurality of concave portions for trapping a hair treatment agent therein is formed on a face of the vibrator facing the receiver or a face of the receiver facing the vibrator so as to include points corresponding to the resonance points of the vibration element.

Since the vibration element has the oblong plate shape so as to have a plurality of resonance points arranged like a periodic lattice on the vibration face, the entire of the vibration face of the vibration element is vibrated substantially even. Thus, the vibrations generated by the vibration element can be transmitted to the hairs or the hair treatment agent evenly and effectively, which are pinched between the vibrator and the receiver. Consequently, the hair treatment agent can be impregnated into the hairs evenly and surely in a widthwise direction of the bundle of hairs. Furthermore, a treatment time for treating the hairs can be shortened due to acceleration of impregnation of the hair treatment agent, and thereby, electric power consumption of the ultrasonic hair treatment device can be reduced.

Still furthermore, since a plurality of concave portions for trapping the hair treatment agent therein is formed on the face of the vibrator facing the receiver or the face of the receiver facing the vibrator so as to include points corresponding to the resonance points of the vibration element, the hair treatment agent trapped in the concave portions can be contacted with the hairs sufficiently while the hairs are pinched between the vibrator and the receiver, and thereby, the hair treatment agent can be impregnated into the hairs sufficiently. Still furthermore, since the hair treatment agent can be trapped at the positions corresponding to the resonance points of the vibration element, the hair treatment agent can be impregnated into the hairs effectively by the vibrations generated by the vibration element.

BEST MODE FOR CARRYING OUT THE INVENTION

Figure 1:
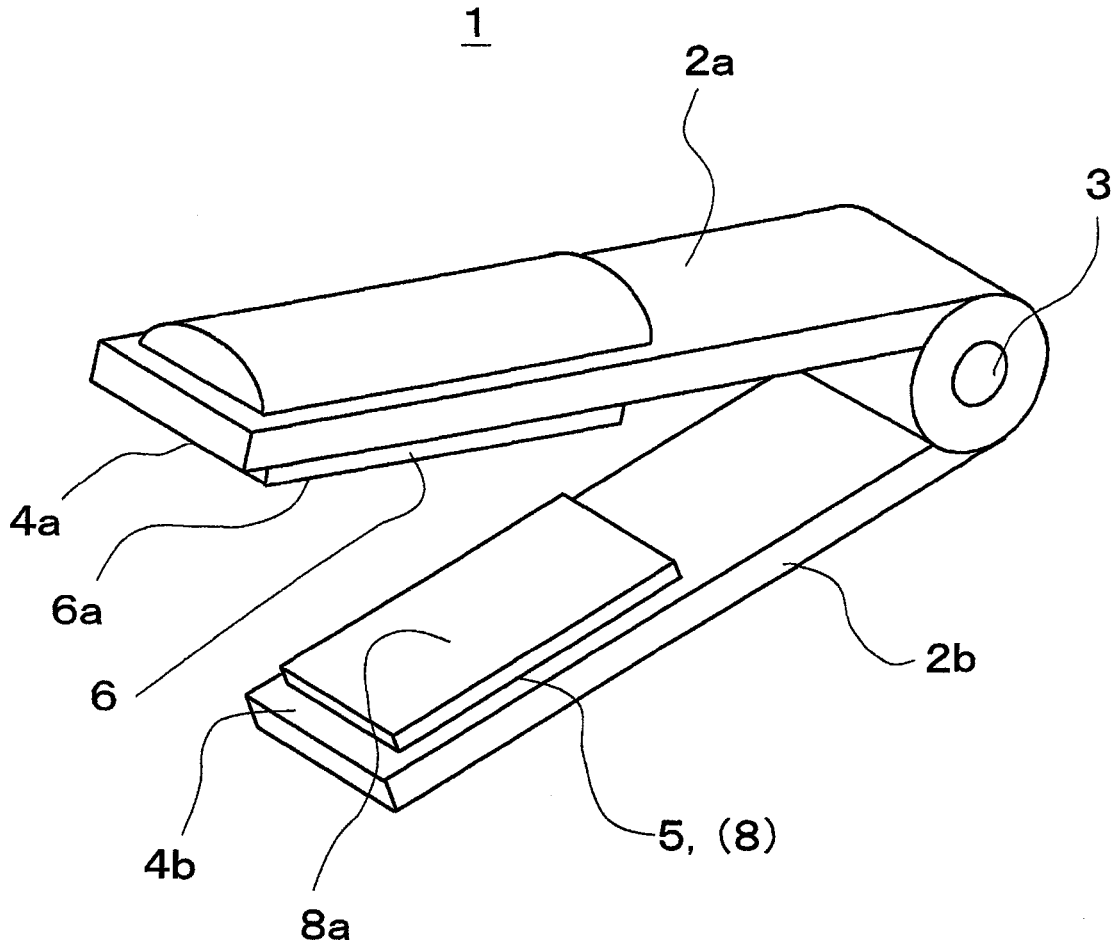
FIG. 1 is a perspective view showing a constitution of an ultrasonic hair treatment device in accordance with an embodiment of the present invention.
Figure 2:
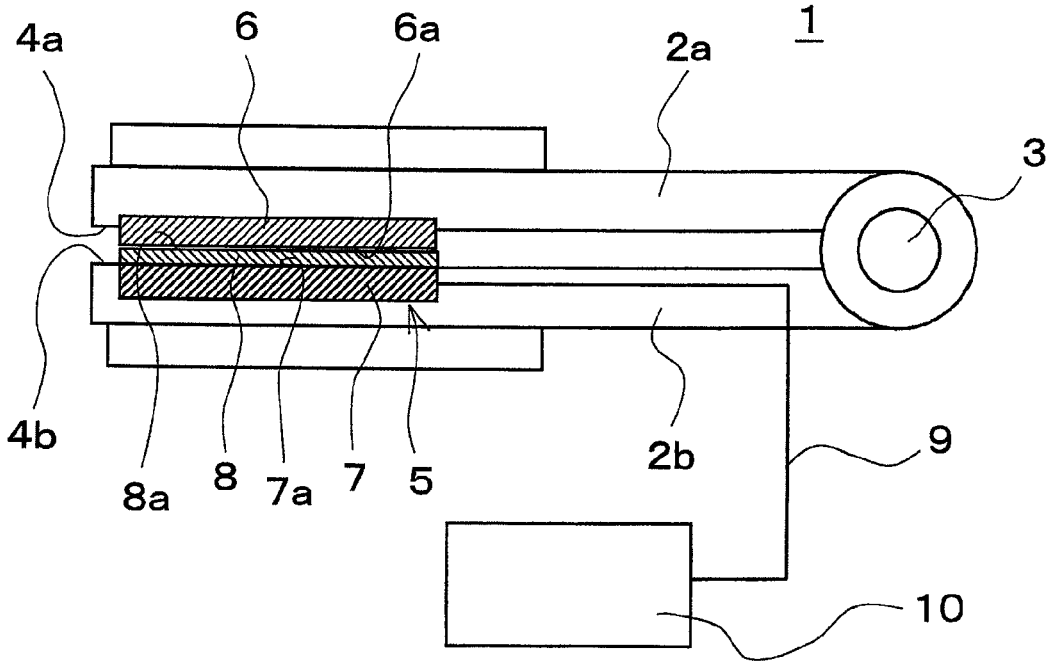
FIG. 2 is a side sectional view showing the constitution of the above ultrasonic hair treatment device.
Figure 3:
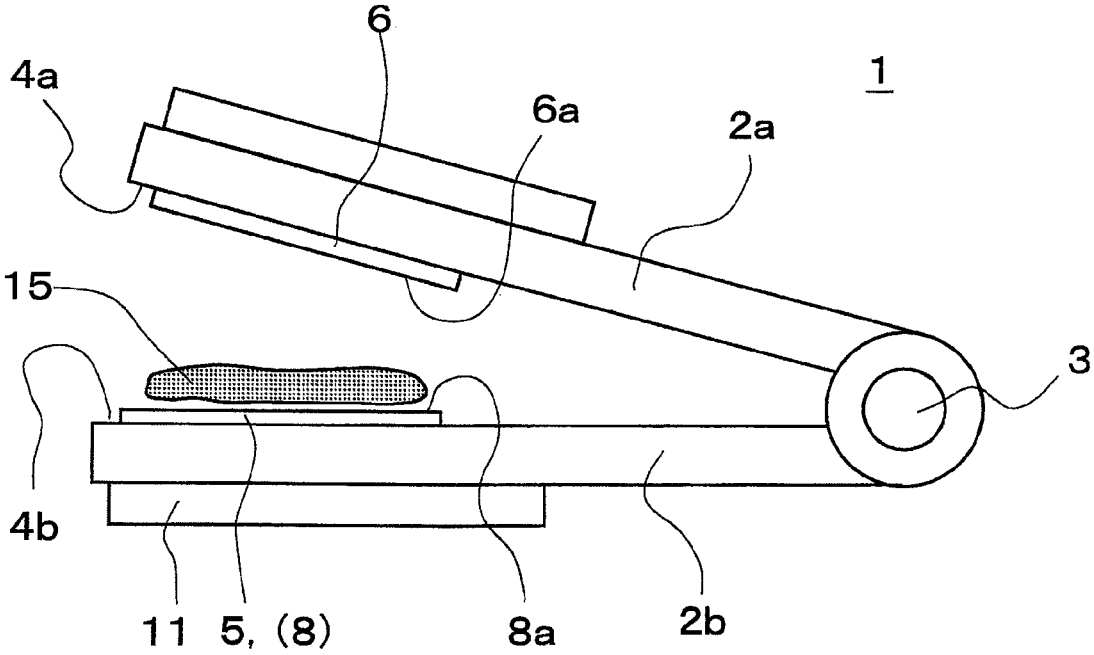
FIG. 3 is a side view showing a condition that a bundle of hairs to be treated is disposed between a vibrator and a receiver of the above ultrasonic hair treatment device.

A preferred embodiment of the present invention is described. FIGS. 1 to 3 respectively show a constitution of an ultrasonic hair treatment device 1 in accordance with an embodiment of the present invention. The ultrasonic hair treatment device 1 comprises a pair of pinching members 2*a* and 2*b* which are rotatably coupled with a hinge 3 at rear ends thereof so as to constitute a two fold pincher. As shown in FIG. 3, one of the pinching members 2*a* and 2*b* can be rotated around the center axis of the hinge 3 with respect to the other in a predetermined angle by, for example, an elastic force of a spring so as to form a space between a front end portion 4*a* of the pinching member 2*a* and a front end portion 4*b* of the pinching member 2*b*. As shown in FIG. 2, when a user holds the pinching members 2*a* and 2*b*, the front end portion 4*a* of the pinching member 2*a* can be closely contacted with the front end portion 4*b* of the pinching member 2*b*. Thus, a bundle of hairs 15 hairs 12 can be pinched between the front end portion 4*a* of the pinching member 2*a* and the front end portion 4*b* of the pinching member 2*b*. Thus, a bundle of hairs 12 can be pinched between the front end portion 4*a* of the pinching member 2*a* and the front end portion 4*b* of the pinching member 2*b*.

A vibrator 5 is provided at the front end portion 4*b* of the pinching member 2*b*, and a receiver 6 is provided at the front end portion 4*a* of the pinching member 2*a*. The receiver 6 is formed of synthetic resin foam such as urethane foam.

Figure 4:
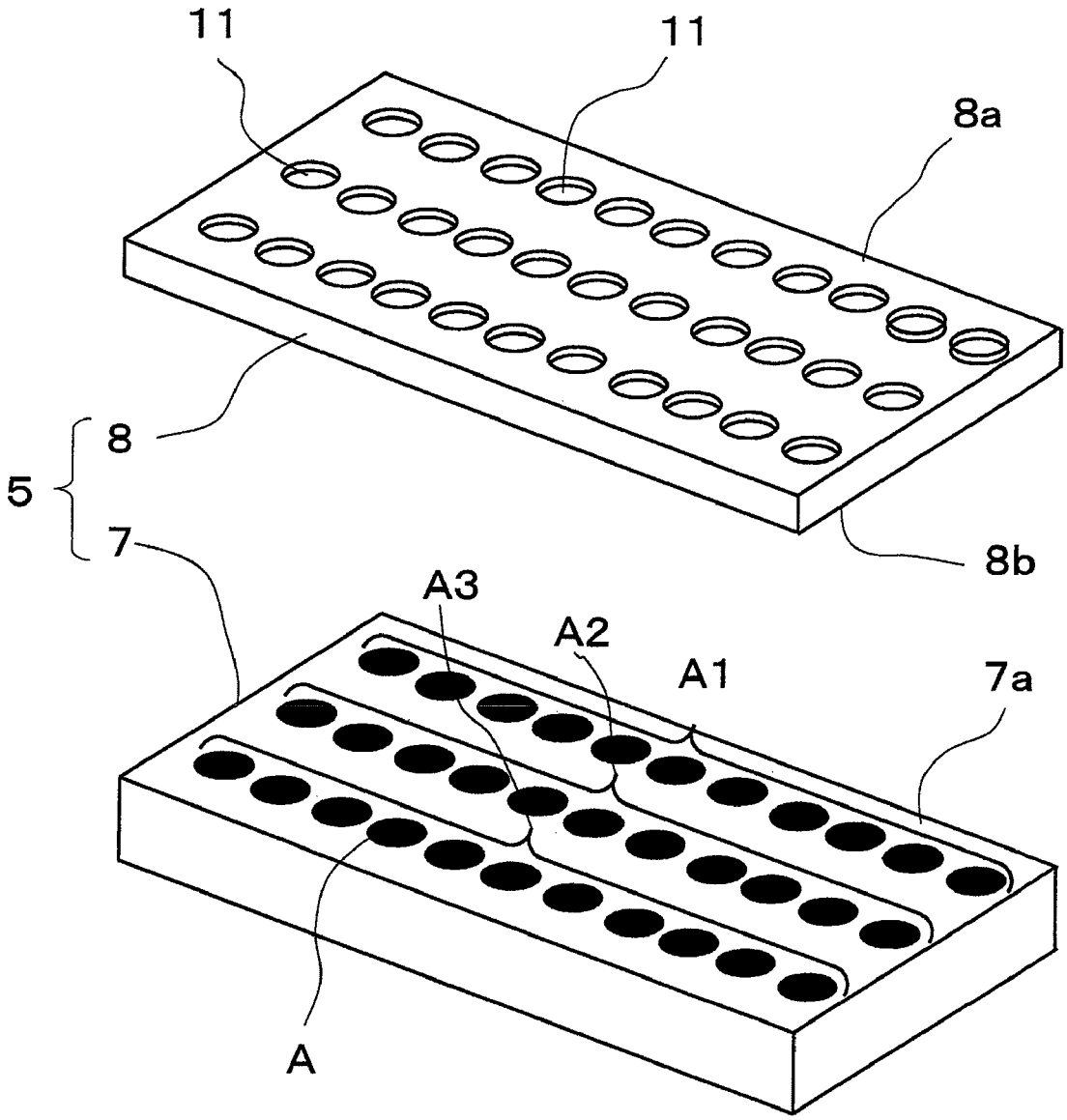
FIG. 4 is a perspective view showing a constitution of the vibrator of the above ultrasonic hair treatment device, and further showing an arrangement resonance points of a vibration element by black dots and recesses of a header of the vibrator in the above ultrasonic hair treatment device.

The vibrator 5 is comprised of a vibration element 7 for generating vibrations and a head 8 for transmitting and radiating the vibrations of the, vibration element to hairs. FIG. 4 shows a constitution of the vibrator 5.

The vibration element 7 has an oblong plate shape longer in a longitudinal direction of the pinching member 2*b*. The vibration element 7 is disposed in a recess formed on the pinching member 2*b* so that a surface of the vibration element 7 becomes parallel with and substantially the same level as the surface of the front end portion 4*b* of the pinching member 2*b*, and an outer periphery of the vibration element 7 contacts with an inner periphery of the recess. A front 7*a* of the vibration element 7 serves as a vibration face.

The head 8 has an oblong plate shape longer in a longitudinal direction of the pinching member 2*b*, similar to the vibration element 7. The head 8 is formed of a hard material such as aluminum and a bottom face 8*b* of the header is laminated on the vibration face 7*a* of the vibration element 7 so that the vibration of the vibration element 7 can be transmitted to the head 8.

The vibration element 7 is electrically connected to a high frequency oscillator 10 which is provided inside or outside of the ultrasonic hair treatment device 1 through a lead wire 9. When a high frequency alternating current is supplied to the vibration element 7 from the high frequency oscillator 10, the vibrations are generated by the vibration element 7. The vibration element 7 utilizes a vibration mode of longitudinal piezoelectric effect in a thickness direction thereof, that is, a mode where the vibration element 7 is vibrated in a longitudinal direction so as to obtain the vibrations in the thickness direction. When a current is supplied to the vibration element 7, the vibration element 7 expands and contracts in both of a longitudinal direction and a transverse direction in the vibration face which is perpendicular to the thickness direction of the vibration element 7. The vibrations in the longitudinal direction interfere with the vibrations in the transverse direction, so that the vibrations in the thickness direction occur. Thus, the vibration face 7*a* of the vibration element 7 is vibrated so that a plurality of the resonance points "A" are arranged like a periodic lattice, as shown by black dots in FIG. 4. Since the vibrations on the vibration face 7*a* of the vibration element 7 are transmitted to the head 8, a radiation face 8*a* of the head 8 opposite to the bottom face 8*b* of the head 8 with the vibration element 7 is vibrated so that resonance points of the radiation face 8*a* are arranged like a periodic lattice to be substantially the same positions as those on the vibration face 7*a* of the vibration element 7. Hereupon, the vibration element 7 is driven so that an output power thereof becomes in a range from 1 to 7 $W/cm^2$.

As shown in FIG. 4, a plurality of circular recesses 11 are formed on the vibration face 8*a* of the head 8 at positions corresponding to the resonance points "A" of the vibration element 7 as a plurality of concave portions so as to trap a hair treatment agent such as a permanent agent, a hairdye, a hair conditioner, or the like. On the other hand, a reception face 6*a* of the receiver 6 facing the vibration face 8*a* of the head 8 is formed to be flat. The vibration face 8*a* of the head 8 except the recesses 11 are formed to be flat so as to be contacted with the reception face 6*a* of the receiver 6, closely.

Usage of the ultrasonic hair treatment device 1 is described. The hair treatment agent is previously spread on the reception face 6*a* of the receiver 6 and the vibration face 8*a* of the head 8 of the vibrator 5 and/or spread to hairs. The ultrasonic hair treatment device 1 is held by a user so that the pinching members 2*a* and 2*b* becomes substantially perpendicular to the bundle of hairs 15 to be treated, and the bundle of hairs 15 is disposed between the vibrator 5 and the receiver 6, as shown in FIG. 3. Under such a condition, when the user grasps the pinching members 2*a* and 2*b* and moves the ultrasonic hair treatment device 1 along a longitudinal direction of the bundle of hairs 15 with driving the vibration element 7, the ultrasonic vibrations generated by the vibration element 7 can be transmitted to the hairs and the hair treatment agent through the head 8. Thereby, impregnation of the hair treatment agent into the hairs can be accelerated.

Since the vibration element 7 is vibrated so that the resonance points "A" are disposed as a periodic lattice observed in the thickness direction as shown in FIG. 4, it is possible to vibrate entire of the vibration face 7*a* of the vibration element 7 substantially even. Consequently, the hair treatment agent can be impregnated into the hairs evenly and surely in a widthwise direction of the bundle of hairs 15. Furthermore, a treatment time for treating the hairs can be shortened due to acceleration of impregnation of the hair treatment agent, and thereby, electric power consumption of the ultrasonic hair treatment device 1 can be reduced. Still furthermore, since the vibration element 7 utilizes the vibration mode of the longitudinal piezoelectric effect in the thickness direction, an energy efficiency of the ultrasonic vibration can be increased in comparison with conventional vibration element utilizing a vibration mode of transverse piezoelectric effect in the thickness direction, that is a mode where the vibration element is vibrated in a transverse direction so as to obtain the vibrations in the thickness direction. Thus, the electric power consumption by the vibration element 7 can be reduced.

Since the recesses 11 are formed on the vibration face 8*a* of the head 8 at the positions corresponding to the resonance points "A" of the vibration element 7 so as to trap the hair treatment agent as shown in FIG. 4, the hair treatment agent trapped in the recess 11 can be contacted with the hairs sufficiently while the hairs are pinched between the vibrator 5 and the receiver 6, and thereby, the hair treatment agent can be impregnated into the hairs sufficiently. Furthermore, since the hair treatment agent can be trapped at the positions corresponding to the resonance points "A" of the vibration element 7, the hair treatment agent can be impregnated into the hairs effectively. Still furthermore, since the recesses 11 are formed on the vibration face 8*a* of the head 8 like a periodic lattice corresponding to the resonance points "A" of the vibration element 7, the hair treatment agent can be trapped at the positions corresponding to the resonance points "A" of the vibration element 7.

Figure 6:
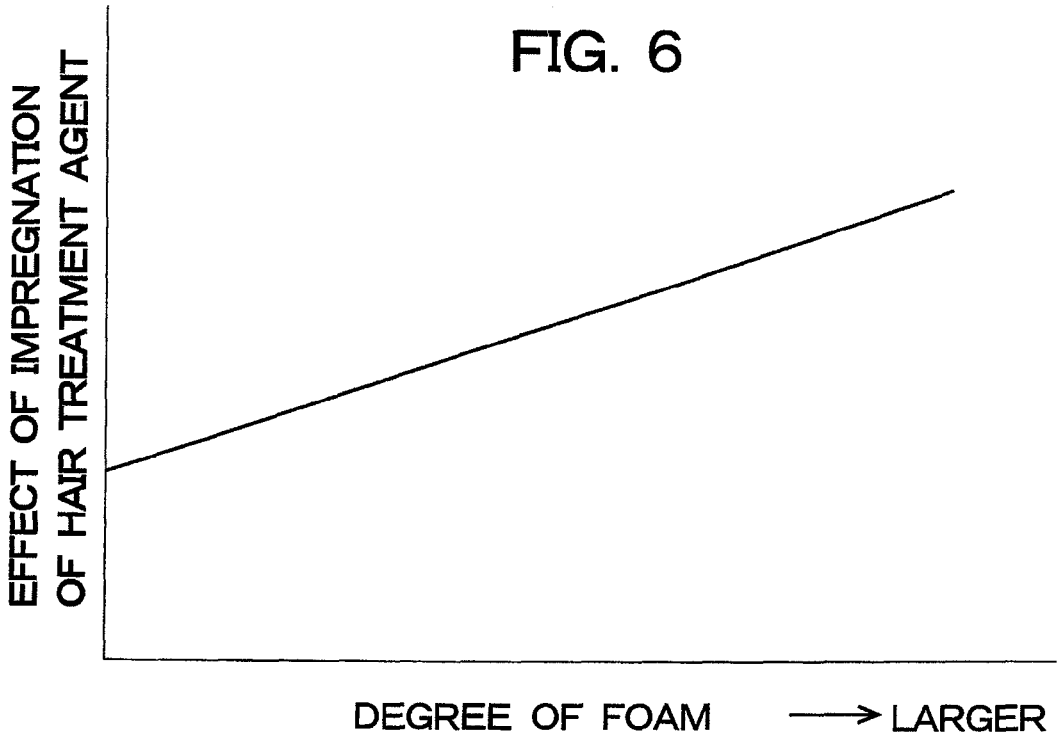
FIG. 6 is a graph showing a relation between degrees of foam of materials of a receiver and effects of impregnation of a hair treatment agent into hairs.

In addition, since the receiver 6 is formed of the synthetic resin foam, the receiver 6 can be deformed responding to the hairs and the recesses 11. Thus, the hairs can be pinched between the vibrator 5 and the receiver 6 surely, and the hair treatment agent can be impregnated into the hairs more effectively. FIG. 6 is a graph showing a relation between degree of form of materials of the receiver 6 and the effect of impregnation of the hair treatment agent into the hairs. As can be seen from FIG. 6, the effect of impregnation of the hair treatment agent into the hairs becomes larger with the increase of the degree of foam.

Figure 7:
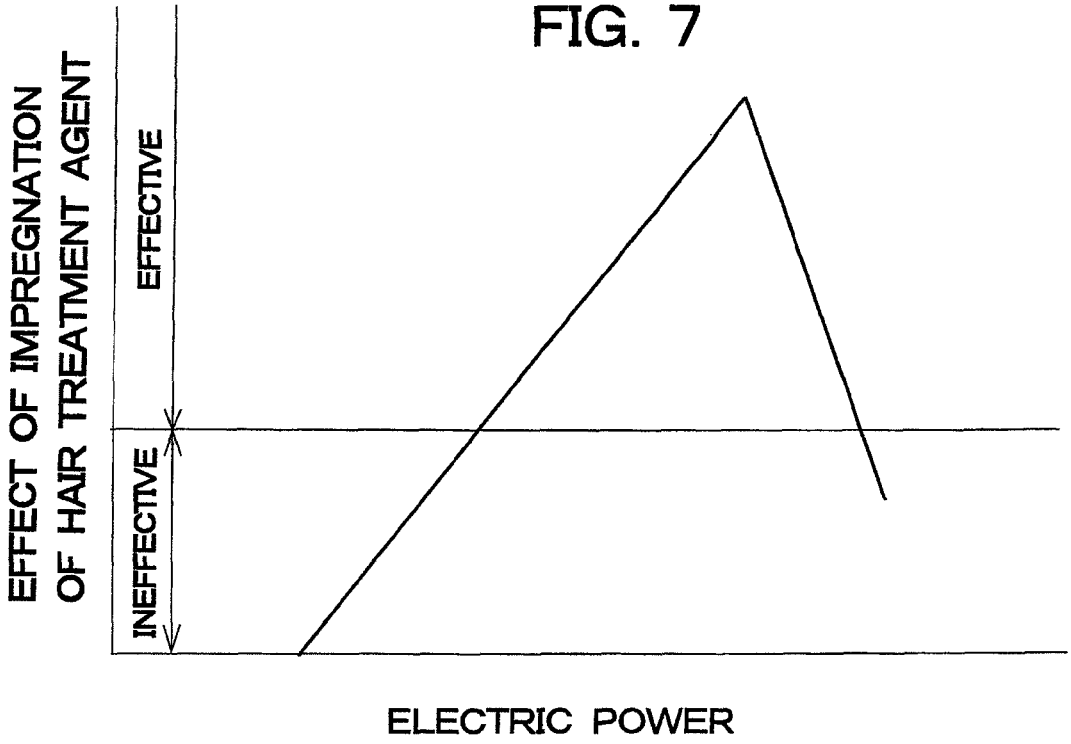
FIG. 7 is a graph showing a relation between output power of the vibration element and the effects of impregnation of a hair treatment agent into hairs.

On the other hand, FIG. 7 is a graph showing a relation between the output power of the vibration element 7 and the effects of impregnation of the hair treatment agent into the hairs. As can be seen from FIG. 7, the effect of impregnation of the hair treatment agent becomes larger in proportion to the increase of the output power of the vibration element 7 for the initial period of time. However, when the output power of the vibration element 7 surpasses a predetermined value, the effect of impregnation of the hair treatment agent becomes smaller in reverse proportion to the increase of the output power of the vibration element 7. Thus, the vibration element 7 should be driven so that the output power thereof becomes in a predetermined range, for example, from 1 to 7 $W/cm^2$.

Figure 5A:
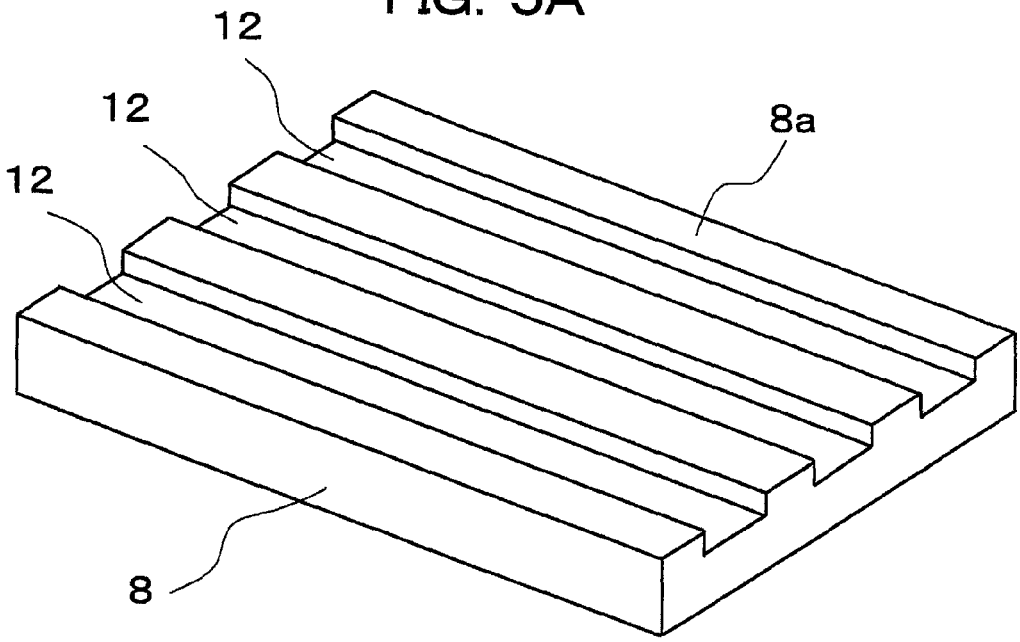
FIG. 5A is a perspective view showing another example of the constitution of the head used in the above ultrasonic hair treatment device.
Figure 5B:
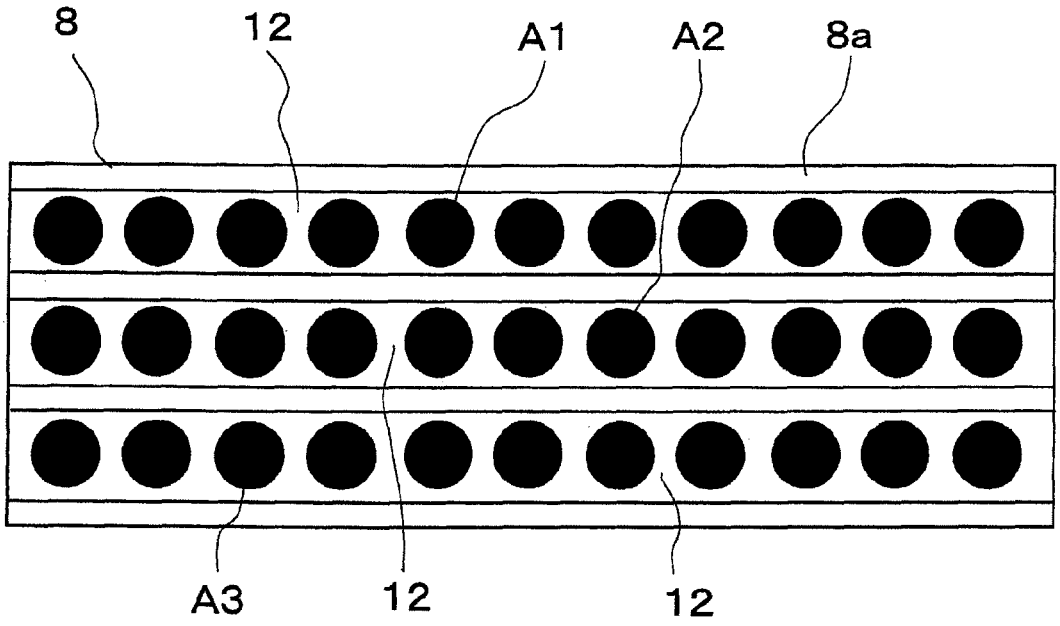
FIG. 5B is a plain view showing an arrangement of resonance points of the head shown in FIG. 5A by black dots.

Subsequently, a modified example of the head 8 is described with reference to FIGS. 5A and 5B. FIG. 5A shows a constitution of the header 8. FIG. 5B shows the resonance points of the head 8 by black dots. A plurality of (for example, three) grooves 12 are formed as a plurality of concave portions so as to trap the hair treatment'agent on the vibration face 8*a* of the head 8 along longer sides of the oblong shape corresponding to the lines, for example, A1 to A3 of the arrays of the resonance points "A" shown in FIG. 4.

According to such a constitution, since the grooves 12 are formed on the vibration face 8*a* of the head 8 including the positions corresponding to the resonance points "A" of the vibration element 7 so as to trap the hair treatment agent, the hair treatment agent trapped in the grooves 12 can be contacted with the hairs sufficiently while the hairs are pinched between the vibrator 5 and the receiver 6, and thereby, the hair treatment agent can be impregnated into the hairs sufficiently. Furthermore, since the hair treatment agent can be trapped at the positions corresponding to the resonance points "A" of the vibration element 7, the hair treatment agent can be impregnated into the hairs effectively.

Besides, in the above mentioned embodiment, the recesses 11 or the grooves 12 are formed on the vibration face 8*a* of the head 8 of the vibrator 5. However, the present invention is not limited to these constitutions. The recesses 11 or the grooves 12 may be formed on the receiving face 6*a* of the receiver 6, and the vibration face 8*a* of the head 8 may be formed flat. Furthermore, the shape of the concave portion for trapping the hair treatment agent is not limited to the circular recess or groove. In other words, it is sufficient that the ultrasonic hair treatment device in accordance with the present invention comprises a vibrator having a vibration element for generating ultrasonic vibrations and a receiver facing the vibrator as to apply the ultrasonic vibrations to a bundle of hairs which is pinched between the vibrator and the receiver. The vibration element has an oblong plate shape so as to have a plurality of resonance points arranged like a periodic lattice on a vibration face disposed in a thickness direction thereof. A plurality of concave portions for trapping a hair treatment agent therein is formed on a face of the vibrator facing the receiver or a face of the receiver facing the vibrator so as to include points corresponding to the resonance points of the vibration element.

It is preferable that the concave portions are circular recesses, each formed at a point corresponding each of the resonance points of the vibration element. Alternatively, it is preferable that the concave portions are grooves formed along a longer side of the oblong plate shape of the vibration element, each including an array of the resonance points of the vibration element.

Furthermore, it is preferable that the vibrator has a header having an oblong plate shape and laminated on the vibration face of the vibration element; and the concave portions are formed on a face of the header facing the receiver. Alternatively, it is preferable that the concave portions are formed on a face of the receiver facing the vibrator.

Still furthermore, it is preferable that the vibration element utilizes a vibration mode of longitudinal piezoelectric effect in a thickness direction thereof. According to such a constitution, an energy efficiency of the ultrasonic vibration can be increased in comparison with conventional vibration element utilizing a vibration mode of transverse piezoelectric effect in the thickness direction. Thus, the electric power consumption by the vibration element can be reduced.

Still furthermore, the receiver is made of a synthetic resin foam. According to such a constitution, since the effect of impregnation of the hair treatment agent into the hairs becomes larger with the increase of the degree of foam, it is possible to impregnate the hair treatment agent into the hairs more effectively.

Still furthermore, it is preferable that a pair of pinching members, rear end of which are hinged is further comprised; and the vibrator and the receiver are respectively provided at front end portions of the pinching members so that a longer side of the oblong plate shape becomes parallel to a longitudinal direction of the pinching member. When a user grasps the pinching members and moves the ultrasonic hair treatment device along a longitudinal direction of the bundle of hairs with driving the vibration element, the ultrasonic vibrations generated by the vibration element can be transmitted to the hairs and the hair treatment agent. Thereby, impregnation of the hair treatment agent into the hairs can be accelerated.

This application is based on Japanese patent application 2005-280921 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

The invention claimed is:

1. An ultrasonic hair treatment device comprising a vibrator having a vibration element for generating ultrasonic vibrations and a receiver facing the vibrator as to apply the ultrasonic vibrations to a bundle of hairs which is pinched between the vibrator and the receiver, characterized by that the vibration element has an oblong plate shape so as to have a plurality of resonance points arranged like a periodic lattice on a vibration face disposed in a thickness direction thereof;

the vibrator has a header having an oblong plate shape and laminated on the vibration face of the vibration element;

a plurality of concave portions for trapping a hair treatment agent therein is formed on a face of the header facing the receiver so as to include points corresponding to the resonance points of the vibration element;

the concave portions are circular recesses, each formed at a point corresponding to each of the resonance points of the vibration element; and a reception face of the receiver facing a vibration face of the header is formed to be flat.

2. The ultrasonic hair treatment device in accordance with claim 1, wherein the vibration element utilizes a vibration mode of longitudinal piezoelectric effect in the thickness direction thereof.

3. The ultrasonic hair treatment device in accordance with claim 1, wherein the receiver is made of a synthetic resin foam.

4. The ultrasonic hair treatment device in accordance with claim 1, wherein a pair of pinching members, rear end of which are hinged; and the vibrator and the receiver are respectively provided at front end portions of the pinching members so that a longer side of the oblong plate shape becomes parallel to a longitudinal direction of the pinching member.

5. The ultrasonic hair treatment device in accordance with claim 1, wherein the vibration face of the header except the recesses is formed to be flat so as to be contacted with the reception face of the receiver, closely.

* * * * *